US006619476B2

(12) United States Patent
Hoch et al.

(10) Patent No.: US 6,619,476 B2
(45) Date of Patent: Sep. 16, 2003

(54) NEEDLE PACKAGE

(75) Inventors: Artur Hoch, Albastdt (DE); Stefan Danner, Bitz (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/121,576

(22) Filed: Apr. 15, 2002

(65) Prior Publication Data

US 2002/0112978 A1 Aug. 22, 2002

Related U.S. Application Data

(63) Continuation of application No. 10/051,288, filed on Jan. 22, 2002, now abandoned.

(30) Foreign Application Priority Data

Jan. 24, 2001 (DE) ..... 101 03 130

(51) Int. Cl.[7] ..... B65D 85/28
(52) U.S. Cl. ..... 206/380; 206/37
(58) Field of Search ..... 206/380–383, 206/38, 227, 37, 37.4, 37.5, 39, 364, 365, 443, 508, 509, 470

(56) References Cited

U.S. PATENT DOCUMENTS

| | | | | |
|---|---|---|---|---|
| 3,967,730 A | | 7/1976 | Driscoll et al. | |
| 4,210,239 A | * | 7/1980 | Takahashi | 206/760 |
| 4,243,141 A | * | 1/1981 | Takahashi | 206/380 |
| 5,067,611 A | | 11/1991 | Hagmann et al. | |
| 5,460,267 A | * | 10/1995 | Schiffer | 206/380 |
| 5,566,822 A | * | 10/1996 | Scanlon | 206/63.3 |
| 5,853,087 A | * | 12/1998 | Sos et al. | 206/380 |
| 6,341,693 B2 | * | 1/2002 | Konno et al. | 206/449 |

FOREIGN PATENT DOCUMENTS

| | | |
|---|---|---|
| CH | 547 744 A | 4/1974 |
| DE | OS 2 255 158 | 5/1973 |
| DE | 19646845 C1 | 2/1998 |
| DE | 196 46 845 | 12/1998 |
| GB | 1407399 | 9/1975 |

* cited by examiner

*Primary Examiner*—Shian Luong
(74) *Attorney, Agent, or Firm*—Venable LLP; Norman N. Kunitz

(57) ABSTRACT

A package (1) for packaging and storing elongated items such as sewing needles (2, 3) has a tray (5) and a lid part (6), which are held or connected together to define a housing space. The tray (5) and the lid part (6) each have a flap-type section (14, 19) at their bead end. These sections can be pivoted toward and away from one another, and can be latched together. When the two flaps (14, 19) are pivoted away from one another, they expose the ends of stored items, e.g., the sewing needles (2, 3), projecting out of the housing space (48), so the items can easily be pulled out of the housing space (48). It is therefore possible to secure the items or sewing needles (2, 3), for example, in a frictional, in the housing space (48).

18 Claims, 6 Drawing Sheets

NEEDLE PACKAGE

CROSS REFERENCE TO RELATED APPLICATION

This application is a continuation of U.S. patent application Ser. No. 10/051,288 filed Jan. 22, 2002, now abandoned.

This application claims the priority of German Patent Application No. 101 03 130.0 filed Jan. 24, 2001, which is incorporated herein by reference.

BACKGROUND OF THE INVENTION

The invention relates to a package far sewing machine needles, in particular, or similar items.

Sewing machine needles or comparable small parts that have an elongated or other shape, such as a curvature, are frequently packaged for transport and sale in a manner that allows for convenient removal of the desired parts. This is especially the case for sewing machine needles, which are sold to sewing machine operators in large numbers. The machine operator would typically prefer to remove the needles from the package individually in order to put them to their intended use. Needles remaining in the package must be carefully stored. This means that the package must be simple to open and close, and the needles or other elongated small parts must be easily accessible in the package and able to be removed individually from the package.

A further, common requirement on the part of needle manufacturers that produce various types of needles is for different types of needles to be packaged in a single package. For example, it may be necessary to combine elongated, straight with elongated, curved needles. Both needle types should be accommodated in one type of package, if possible. It is also often desirable to accommodate as many needles as possible in one package.

German Patent DE 196 46 845 C1 discloses a package for sewing machine needles, which is embodied as a flat, rectangular case with a plurality of parallel retaining tabs. The tabs can be opened individually, so only one or a few needles can be removed from the package while the others remain securely held in the package. When all of the retaining tabs are opened at once, the needle ends remain more or less freely accessible in the housing part.

Based on this prior art, it is the object of the invention to provide a package that is especially suitable for sewing machine needles and improves the handling of the needles.

SUMMARY OF THE INVENTION

The above object generally is achieved according to the present invention by a package for elongated items such as sewing machine needles or similar items, comprising: a flat tray that limits a housing space for the elongated items, at least on one side; a flat lid part; means connected to the flat tray for holding the lid part at a distance from and substantively parallel to the tray so as to limit the housing space on a side opposite the tray; and with the tray having a movable tray section at one end thereof, the lid part having a movable lid-part section at one end thereof and opposite the moveable tray section of the tray, and a detachable connecting element connecting the tray section and the lid-part section to one another.

The package in accordance with the invention has a movable tray section and a movable lid-part section. Furthermore, the tray section and the lid-part section are connected to one another by a detachable connecting element. When the moveable parts are connected, the housing space surrounded by the package is closed, and the needles or other elongated items in the package are held securely and cannot fall out.

For opening the package, the detachable connecting element is released, so the movable tray section and the movable lid section can be pivoted apart. The tray section and the lid-part section thus expose both sides of the needle shanks or the ends of other types of elongated parts stored in the housing space, making them freely accessible. They can be grasped easily and removed from the package. This is the case for both straight, elongated parts (straight machine needles) and curved, elongated parts (specialty curved sewing machine needles).

The above-described type of sewing machine needle package with a movable tray section and an oppositely-located, movable lid-part section also offers the option of securing the elongated items (sewing machine needles) in the housing space with, for example, a foam strip or other resilient means, to prevent any play of the items. Overcoming the resulting clamping effect allows the elongated items to be removed from the housing space. The elongated items are nevertheless securely held in the housing space, i.e., in the package, even if the package is open. This is advantageous for straight and curved sewing machine needles. In comparison to packages of the same size but other designs, this package can accommodate significantly more sewing machine needles or elongated items. The sewing machine needles or items can be arranged adjacently without spacers, in other words, touching each other, in the housing space.

In comparison to other, known packages, the handling of the package is particularly improved by the fact that, after the package has been opened, the sewing machine needles or elongated items protrude far enough from it to be grasped on two sides and removed from the package. In addition, the package in accordance with the invention protects the needles or items from inadvertently falling out of the housing space, with the use of the corresponding means described above.

In a preferred embodiment, the moveable tray section and the moveable lid-part section are connected to the tray and the lid part, respectively, by a respective hinge element, with the hinge elements defining parallel pivoting axes. This facilitates the opening and re-closing of the package. If the package is held in one hand, the thumb can open the tray section and the lid-part section. The user can then use the other hand to remove the elongated items (sewing needles).

The hinges are preferably embodied as live hinges. Moreover, a live hinge can connect the lid part to the tray. Thus, the entire case body, comprising the tray and the lid part, can be produced in one piece, for example, as an injection-molded part. The live hinges also seal the housing space against the penetration of dirt or moisture in the hinge region.

The package can be trapezoidal or rectangular in a plan view, or be adapted to the shape of the items it is to contain. The rectangular shape is preferred. Side walls resting against oppositely-located edges adjoin the floor section, projecting essentially perpendicular from the floor. The side walls are preferably provided with a fastening element for connecting the lid part to the floor part. This fastening element takes the form of a latching part, which can be embodied by latching grooves on the inside of the side walls of the tray part and a corresponding latching rib on the side edges of the lid part. This type of latching element is advantageous for several reasons. It secures the lid part over virtually its entire length, thereby preventing it from bowing. This is particularly advantageous if, for example, a foam strip or another resilient or clamping means is disposed in the housing space for securing the elongated items. Aside from this, it is of great advantage for the lid part to be latched to the side wall over its entire length. This lends the package considerable stability.

This concept further offers the option of easily forming a neat stack from individual packages. It the side walls protrude past the lid part, the underside of the package can be provided with corresponding, open-edged grooves, which can receive the upper side-wall section of an identical package.

For connecting the individual packages in the stack, they can be provided with further latching elements, for example, in the form of openings in the floor part and corresponding latching pins on the lid part.

The package has a rigid, unopenable section and a movable section that can be opened. The rigid part of the package is formed by the regions of the tray and the lid part that are fixedly latched together. The other part is formed by the movable tray section and lid-part section. In the closed state, the package should be rigid overall. This is effected by an abutment that preferably supports at least the tray section on each side of the package (at the side walls) so as to limit the pivot angle of the tray section. It has been seen that an abutment of this type lends the package considerable stability.

The abutment is preferably embodied or formed to simultaneously act as a clamping device for the lid part. This can be ensured by providing the abutment with corresponding wedge surfaces that cooperate with the side wall adjacent to the abutment, and clamp the lid part at least slightly in the longitudinal direction when it is latched with the tray. The movable tray section is then supported against the abutments connected to the lid part.

If the movable lid-part section has a latching tab that extends beyond the tray section, the package is rigid overall when closed. This is because the receiving-part section cannot be pivoted out beyond an extreme position in which it rests against the abutment. The lid part extending past the tray section with a tab at its free end prevents the tray section from being pivoted in the opposite direction. The tab and the abutment form a clamp, between which he receiving-part section is held without being able to pivot.

The lid-part section is preferably provided with a finger depression, which greatly facilitates one-handed handling, that is, opening and closing the package with one hand.

These and other details and advantageous features of the invention ensue from the drawings and/or the description. The drawing illustrates embodiments of the invention.

DESCRIPTION OF THE PREFERRED EMBODIMENTS

Figure 1:
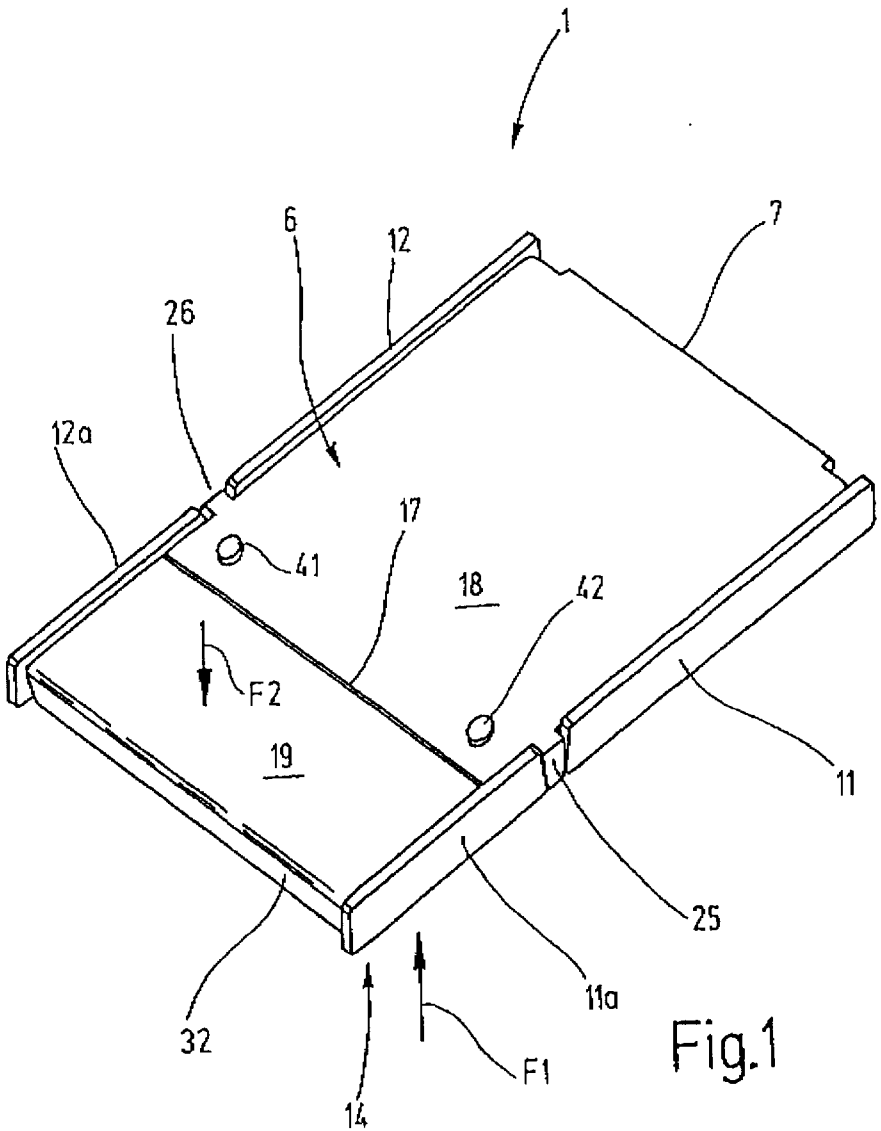
FIG. 1 is a perspective view of the package according to the invention, in the closed state.
Figure 7:
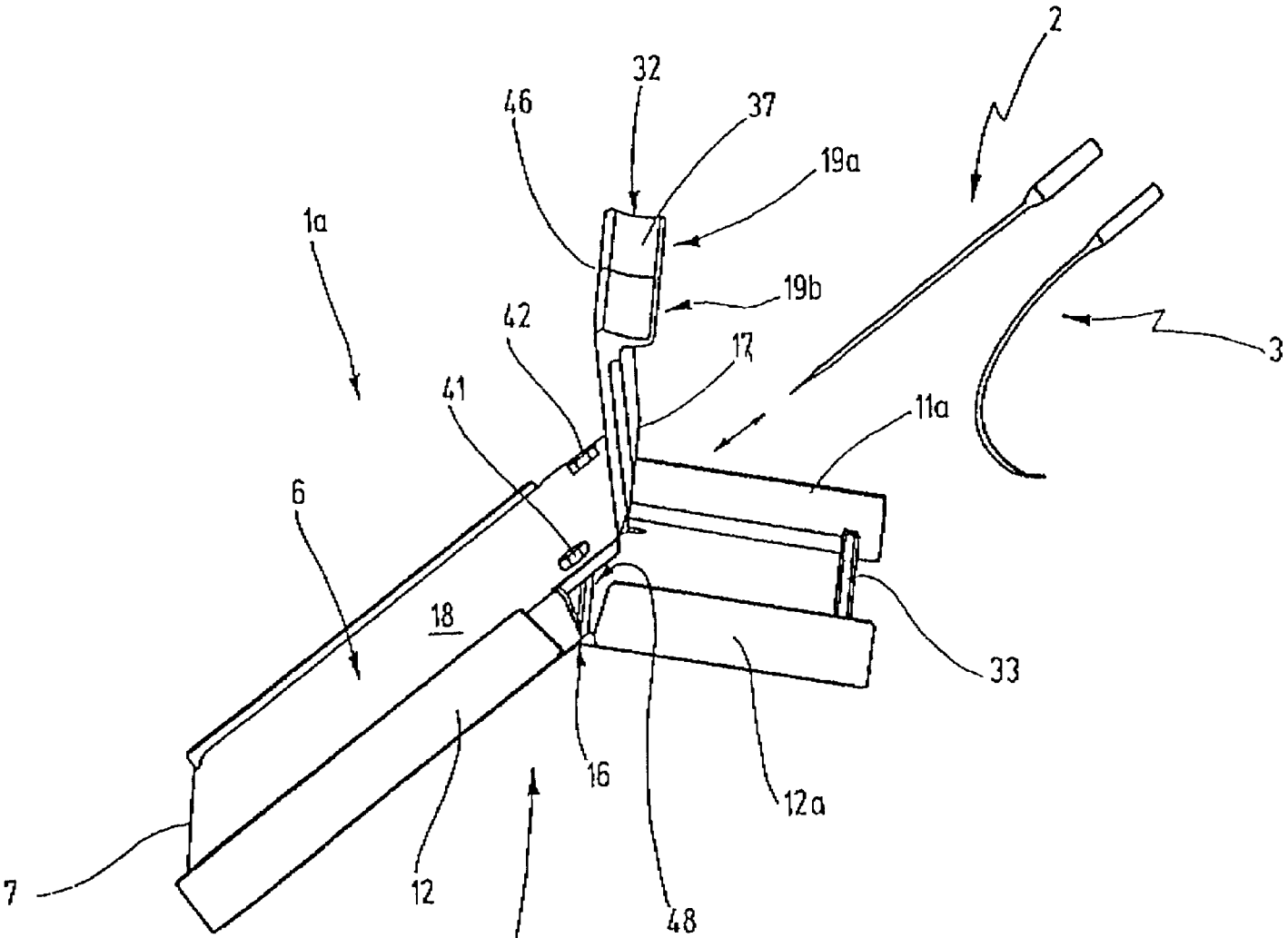
FIG. 7 is a perspective view of the package according to FIG. 6, completely open and with two elongated sewing needles, by way of example.

FIG. 1 illustrates a package 1 that serves in storing sewing needles 2, 3, as shown by way of example in FIG. 7. The sewing needle 2 is straight, while the sewing needle 3 is elongated, but curved. Both needle types can be packaged and transported in the package 1 in accordance with FIG. 1 or the package 1*a* in accordance with FIG. 7.

Figure 4:
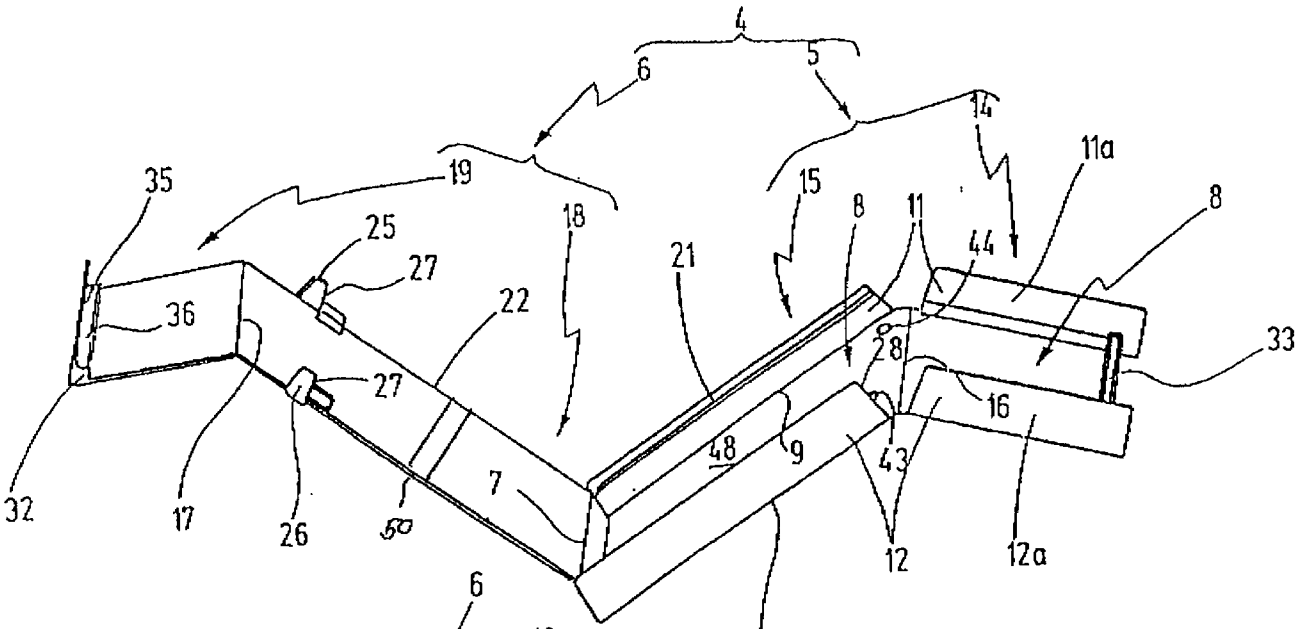
FIG. 4 is a perspective view of the package according to FIGS. 1 through 3, after the production of its case body and before the latching of the lid part to the tray.

The package 1 according to FIG. 1 has a case body 4, which can be seen in FIG. 4 and is produced from plastic, for example, as a unitary piece in an injection-molding procedure. The case body 4 includes a tray 5 and a lid part 6, which are connected to one another by a live hinge 7. The live hinge 7 is formed by a linear region of significantly-reduced material thickness (wall thickness) extending over virtually the entire width of the lid part 6 or the tray 5.

The tray 5 has a flat, rectangular floor section 8. Side walls 11, 12 extend at a right angle away from two oppositely-located edges 9, 10 of the floor section 8, and a back wall 13 that extends perpendicular from a rear edge of the floor section 8 between the side walls 11 and 12. The floor tray 5 is subdivided into a movable tray section 14 and a stationary tray section 15 via a live hinge 16. The side walls 11, 12 have a break in the region of the live hinge 16 extending through the floor section a from the edge 9 to the edge 10. The side walls 11, 12 are formed to have a gap in the region of the live hinge 16 when the movable tray section 14 is oriented such that the entire floor section 8 is held level (i.e., in one plane).

The lid part 6 is essentially formed by a rectangular, rigid section that is subdivided by a live hinge 17 into a stationary lid-part section 18 and a movable lid-part section 19. The lid-part section 18 extends from the live hinge 7 to the live hinge 17, and its length is greater than the length of the tray section IS that can be defined by the spacing of the live hinge 7 from the live hinge 16.

The lid-part section 18 is provided with an arrangement to connect it to the tray section 15. Corresponding fastening means, preferably embodied as latching elements, are provided for this purpose. In the present exemplary embodiment, the fastening means act between the side walls 11, 12 and the lid part 6. As can be seen, the side wall 11 has a latching groove 21, which extends parallel to the edge 9 near the upper, free edge of the side wall 11. The latching groove 21 extends along the inside of the side wall 11, from the live hinge 7 up to the gap present in the side wall 11 at the live hinge 16.

Figure 5:
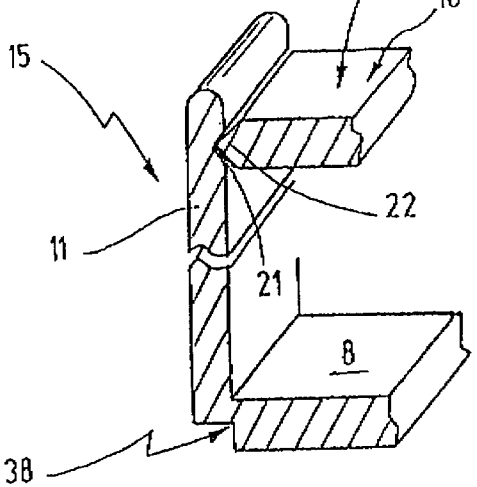
FIG. 5 shows the package according to FIG. 4, in a cutout, perspective view on a different scale.

The embodiment of the latching groove 21 is best illustrated by FIG. 5. For securing the lid-part 18 to the tray section 15, the lid-part section 18 is provided with a latching rib 22 on its edge extending away from or perpendicular to the live hinge 7. The cross-section of this rib 22 fits the latching groove 21. In one example, the latching groove 21 has a prismatic cross-section, and the latching rib 22 has a triangular cross-section. The side wall 12 is provided with a corresponding latching groove, insofar that it is a component of the tray section 15. Correspondingly, the edge of the lid-part section 18 facing the wall 12 is also provided with a latching rib. Hence, the latching device of the side wall 12 is mirror-symmetrical to the latching device of the side wall 11.

Figure 3:
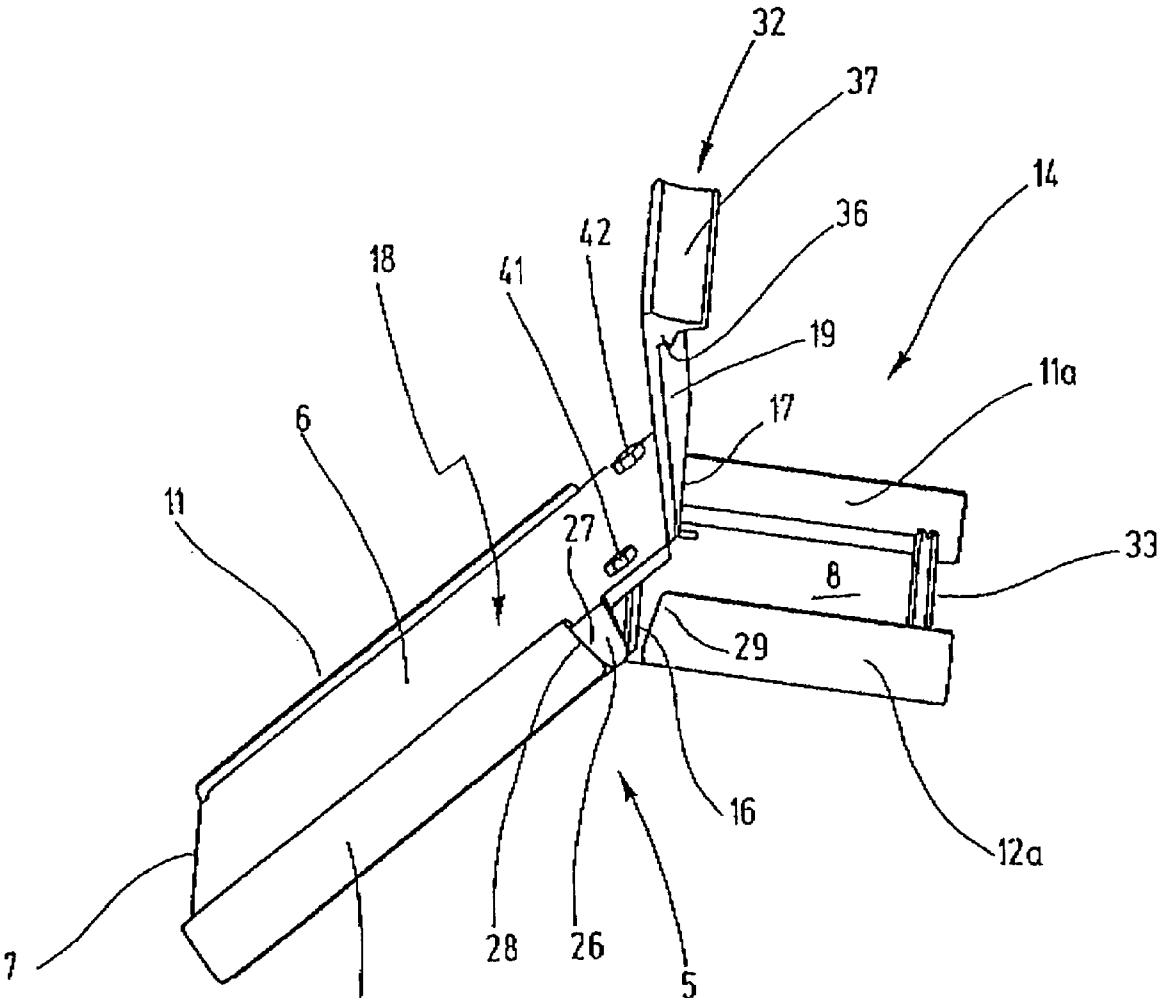
FIG. 3 is a perspective view of the completely-open package according to FIGS. 1 and 2.

As ensues from FIG. 4 and particularly FIG. 3, the lid-part section 18 is provided with a respective protrusion 25, 28 in its two side-flank regions that cover the live hinge 16 when the package 1 is closed. The respective protrusion 25 or 26 extends into the gap in the side wall 11 or 12 arid forms an abutment for the tray section 14. The protrusions 25, 26 are mirror-symmetrical relative to one another, so the following description of the protrusion 26 also applies to the protrusion 25.

The protrusion 26 has a trapezoidal shape in a side view. On its side facing the live hinge 7, the protrusion 26 has an inclined surface 27, which is associated with a corresponding inclined surface 28 at the end face of the side wall 12. The inclined surfaces 27, 28 act as wedge surfaces, as can be seen in FIG. 3. When the lid part 6 and the tray 5 are brought together, the inclined surfaces 27, 28 come into contact, which provides a fixed stop of the protrusion 25, 26 against the side wall 11, 12 and keeps the lid part clamped at least slightly away from the live hinge 7. It is crucial that the protrusion 25, 26 rest against the relevant side wall 11, 12 without play.

The protrusions 25, 26 extensively correspond in shape to the respective gaps in the side wall 11 and 12. The side-wall sections 11*a*, 12*a* of the tray section 14 also have inclined surfaces 29 at their end faces facing the protrusions 25, 26. When the floor 8 of the tray 5 is held level, that is, straight, these inclined surfaces 19 rest against the corresponding wedge or inclined surfaces of the protrusions 25, 26. The tray section 14 can therefore be folded away from the lid part 6, as shown in FIG. 3, but not beyond the extended position to the lid part 6. The protrusions 25, 26 therefore form abutments for the tray section 14. The latter is particularly visible in FIG. 2.

Figure 2:
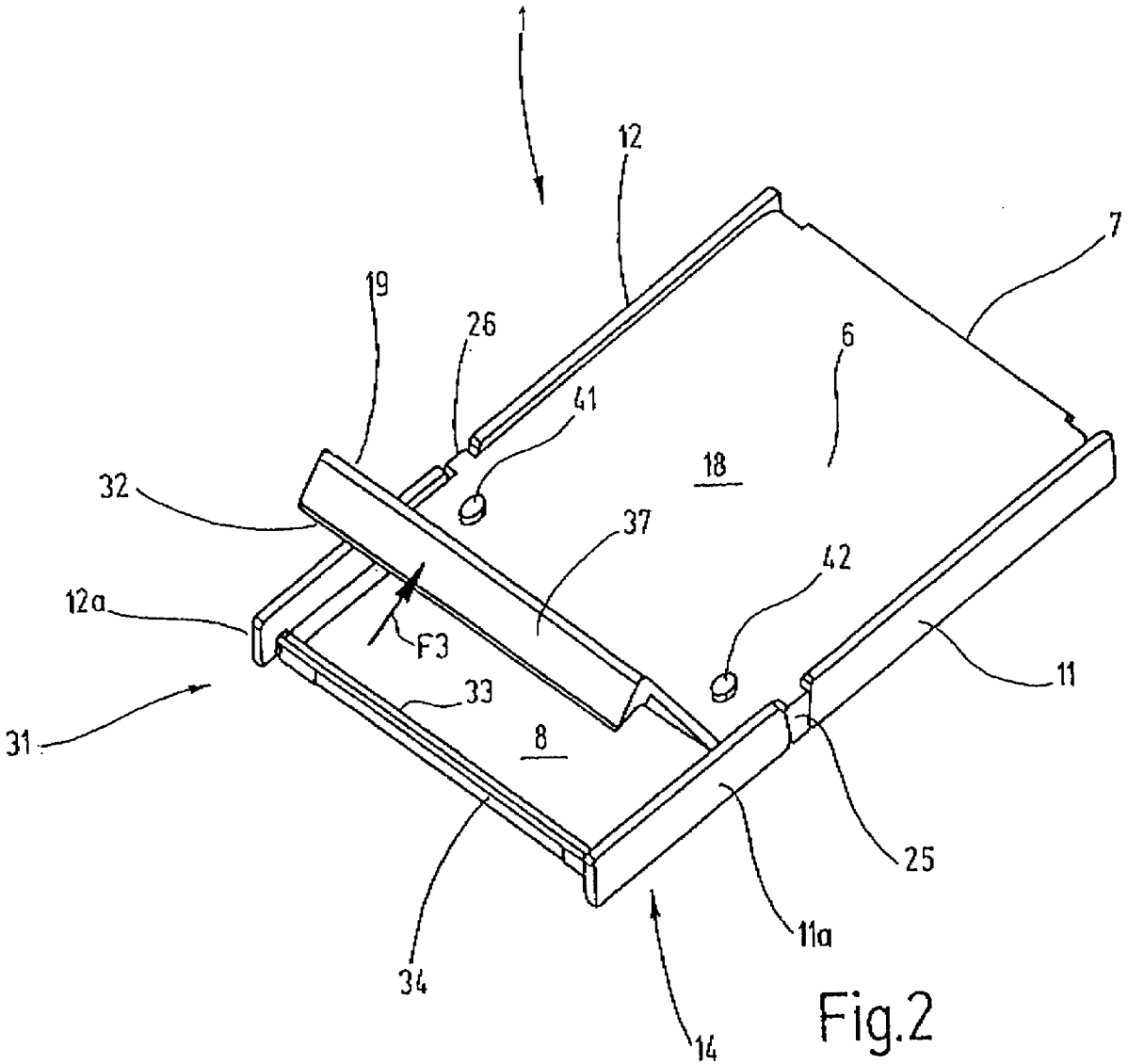
FIG. 2 is a perspective view of the package according to FIG. 1i with an open lid-part section.

As can also be seen in FIG. 2, a connecting element that is formed by a latching device 31 is provided for connecting the lid-part section 19 and the tray section 14. This device includes a latching tab 32, which is formed at the distal end of the lid-part section 19, extends over the entire width of the lid-part section 19, and is oriented approximately at a right angle to the lid-part section 19 (See FIG. 3). The latching tab 32 extends past a web 33 that is disposed at the free end of the floor 8 of the tray section 14, and extends from the side-wall section 11*a* to the side-wall section 12*a*. This web 33 is provided with a latching recess 34 on its side facing away from the package 1, as illustrated in FIG. 2. The recess 34 has an associated, rib-like catch 35 that is formed on the latching tab 32, as can be seen in FIG. 4.

The latching recess 34 is formed by a groove into which the catch 35 can snap due to the resilient effect of the latching tab 32. To prevent the lid-part section 19 from moving past the latching position, the inside of this section 19 is provided with a supportive step 26 that extends parallel to the latching tab 32, over the inside of the lid-part section 19. In the latched state, when the catch 35 is seated in the latching recess 34, the supportive step 36 rests against the top of web 33.

To improve handling, and particularly to permit one-handed opening of the package 1, the latching tab 32 is preferably provided with a finger depression 37 in its front or outer surface (FIG. 3). To form this depression, the latching tab 32 has a concave arch on its side facing away from the package 1. For example, the arch can follow a cylindrical surface. Other gripping aids such as nubs, protrusions or the like are likewise possible, The package 1 described to this point is stackable. For this purpose, the side walls 11, 12 are formed to protrude beyond the surface of the lid part 6, as shown in FIG. 5 for the side wall 11. The latching groove 21 is spaced vertically from the top edge of the side wall 11 such that the side wall protrudes by at least fractions of a millimeter beyond the upper surface of the lid part 6. Correspondingly, an open-edged stacking groove 38 is formed on the underside of the package 1, at a corner location where the floor 8 changes over to the side wall 11 or 12. The stacking groove is capable of receiving the upper, free edge of the relevant side walls 11, 12 of an identical different package. In addition, as ensues from FIGS. 1 and 2, latching pins or latching nubs 41, 42 are provided on the outer surface of the lid-part section 18; and corresponding latching openings 43, 44 (FIG. 4) are disposed in the floor 8. The latching openings 43, 44 and the latching nubs 41, 42 are matched to one another such that corresponding packages 1 hold each other in place when the latching nubs 41, 42 are inserted into the latching openings 43, 44.

Figure 6:
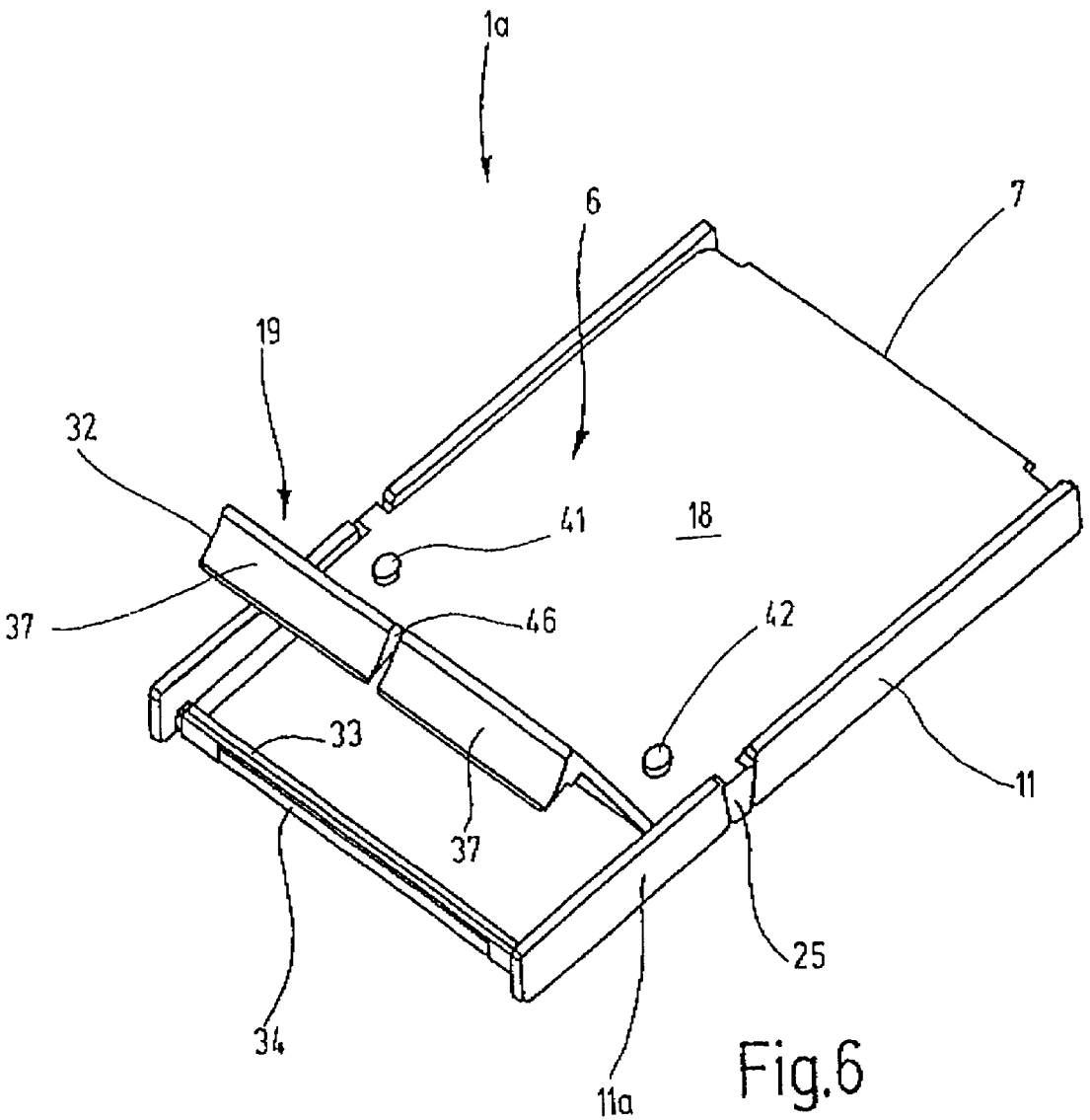
FIG. 6 is a modified embodiment of the package in accordance with the invention, partly open and in a perspective view.

FIGS. 6 and 7 illustrate a modified embodiment of the package 1 as a package 1*a*. A significant difference between the package la and the above-described package 1 lies in the fact that the lid-part section 19 is subdivided in the longitudinal direction of the package into two lid-part sections 19*a*, 19*b* that can be opened and closed independently of one another. This is attained with a slot 46 that extends from the latching tab 32 to the live hinge 17.

The package 1 or 1*a* is handled as follows:

For producing the package, first the case body 4 shown in FIG. 4 is manufactured as a unitary structure. In the assembly stage, the lid part 6 is connected to the tray 5 through the latching of the latching ribs 22 in the latching grooves 21. Hence, the housing space 48 is enclosed. The housing space 48 serves in holding the sewing needles 2 or 3, as shown in FIG. 7.

The sewing needles 2 or 3 can be inserted into the housing space 48 the first time that the case body 4 is closed (assembled). In the process, the relevant elongated items, such as the sewing needles 2 or sewing needles 3, are inserted into the tray 5. After the lid part 6 has been completely latched with the tray 5, the sewing needles 2 or 3 are held in the housing space 48.

If the sewing needles 2, 3 are to be accommodated in the housing space 48 without play, a resilient element such as a foam strip, can be additionally inserted into the housing space 48. In this case, first the sewing needles 2 or 3 are inserted into the housing space 48, and a corresponding foam strip is then placed onto the sewing needles 2, 3. When the lid part 6 is closed and latched with the tray 5, the lid part 6 fixedly clamps the foam strip and the sewing needles 2 or 3 against the floor 8 in the housing space 48.

As an alternative, a foam strip or other resilient element 50 can be connected to the lid part 6, particularly the lid-part section 18 (e.g., with glue or adhesive materials). The latching ribs 22 and latching grooves 21 hold the lid part 6 securely against the tray 5, thereby preventing the package from bulging or bending under the effect of the foam strip.

As an alternative, the package 1 can be closed, then filled from the end face when the tray section 14 and the lid-part section 19 are pivoted away from one another such that the housing space 48 is open on one side.

After the package has been filled, the case body 4 can be completely closed through the latching of the lid part 6 with the tray 5 at the side walls 11, 12, and the latching of the lid-part section 19 with the tray section 14 by means of the latching tab 32 (FIG. 1). The package 1 is stable (rigid) in this state. If pressure is exerted onto the tray section in the direction of an arrow F1, the side-part sections 11*a*, 12*a* encounter a fixed abutment at the protrusions 25, 26, and prevent a perceptible deformation of the package 1. If, in contrast, a force is exerted onto the lid-part section 19 in the direction of the arrow F2, the latching tab 32 extending past the tray section 14 prevents a pivoting movement of the unit formed by the lid-part section 19 and the tray section 14. This is especially the case because the lid-part section 19, measured from the live hinge 17 to the latching tab 32, is shorter than the tray section 14, measured from the live hinge 17 to the web 33.

Despite the stability and the resistance of the package 1 to unintentional opening, the package can be opened simply and comfortably, as shown in FIG. 2. If the package 1 is being held with one hand, the user can open the lid-part section 19 by pushing it away from the floor-part section 14, for example by pressing the finger depression 37 with the thumb. The latched connection between the latching tab 32 and the latching recess 34 releases. When the latched connection opens, the contact of the side-wall sections 11*a*, 12*a* with the protrusions 25, 26 prevents the tray section 14 from pivoting along, so the pressure of the thumb in the direction of the arrow F3 in FIG. 2 opens the flap formed by the lid-part section 19.

After the lid-part section 19 has been opened, the tray section 14 can be pivoted away from the lid-part section 19, as shown in FIG. 3. This can be effected by sliding the thumb back. The ends of the needles 2, 3 housed in the housing space 48 now project out of the housing space 48. They can easily be grasped and removed.

once the desired number of needles 2, 3 has been removed from the housing space 48, the package 1 or 1*a* can be re-closed simply by moving the tray section 14 and the lid-part section 19 (or 19*a* and 11*b*) back together until the latching tab 32 latches with the web 33. The package 1 can thus be opened and re-closed practically an arbitrary number of times.

In the above-described exemplary embodiments, it is always assumed that the housing space 48 is empty, that is, free from any partitions, protrusions or other structures that separate the sewing needles 2 or 3. If necessary, however, it is possible to provide ribs or intermediate walls that extend parallel or at an acute angle relative to the side walls 11, 12, and are connected to the floor a or the lid part s, in the housing space 48. In the interest of maximizing the use of the internal volume of the housing space 48, however, it is advantageous not to use such separator elements. This particularly allows curved needles 3 to be accommodated in the package 1 in heretofore unheard-of numbers.

In summary, a package 1 for packaging and storing elongated items such as sewing needles 2, 3 has a tray 5 and a lid part 6, which are held together. The tray 5 and the lid part 6 have a flap-type section 14 and 19, respectively, at their head or front end. The sections 14, 19 can be pivoted toward and away from one another, and may be latched together. When the two flaps 14, 19 are pivoted away from one another, they expose the ends of the sewing needles 2, 3 projecting out of the housing space 48, so the needles can easily be pulled out of the housing space 48. It is therefore possible to secure the sewing needles 2, 3, for example, in a frictional lockup, in the housing space 48.

The invention now being fully described, it will be apparent to one of ordinary skill in the art that many changes and modifications can be made thereto without departing from the spirit or scope of the invention as set forth herein.

What is claimed is:

1. A package for elongated items such as sewing machine needles or similar items, comprising:

a flat tray, which limits a housing space for the elongated items, at least on one side;

a flat lid part;

means connected to the flat tray for holding the lid part at a distance from and substantively parallel to the tray so as to limit the housing space on a side opposite the tray;

said tray having a movable tray section at one end thereof and a flat, rectangular floor section that is provided with side walls that extend toward the lid part at two oppositely-located, parallel edges;

said lid part having a movable lid-part section at one end thereof and opposite the movable tray section of the tray; and a detachable connecting element connecting the tray section and the lid-part section to one another.

2. The package according to claim 1, wherein: the movable tray section is connected to a remainder of the tray by a hinge element extending traverse to a longitudinal axis of the package; the lid-part section is connected to a remainder of the lid-part by a hinge element; and the hinge elements and both movable sections define pivot axes that are oriented parallel to one another.

3. The package according to claim 2, wherein the hinge elements are live hinges.

4. The package according to claim 1, wherein the means for holding includes elements securing the lid part to the tray provided at the side walls.

5. The package according to claim 4, wherein the elements are latching elements.

6. The package according to claim 4, wherein the means for holding further includes an end wall disposed at another end of the tray and lid parts and connected to both to close off the housing space at said another end.

7. The package according to claim 6, wherein the tray, the lid part and the end wall are formed from a single piece of material and the tray and lid parts are connected to the end wall via respective parallel live hinges.

8. The package according to claim 1, wherein the side walls protrude past the lid part, and a respective stacking groove is recessed into each outer edge of the tray at which a respective side wall is connected to the floor section of the tray.

9. The package according to claim 4, further comprising a non-divided housing space.

10. The package according to claim 1, wherein at least one of the movable lid-part section and the moveable tray section is subdivided in the longitudinal direction.

11. The package according to claim 1, further including means for frictionally securing elongated items in the housing space.

12. A package for elongated items such as sewing machine needles or similar items, comprising:

a flat tray, which limits a housing space for the elongated items, at least on one side;

a flat lid part;

means connected to the flat tray for holding the lid part at a distance from and substantively parallel to the tray so as to limit the housing space on a side opposite the tray;

said tray having a movable tray section at one end thereof;

said lid part having a movable lid-part section at one end thereof and opposite the movable tray section of the tray;

a detachable connecting element connecting the tray section and the lid-part section to one another; and wherein the tray and the lid parts are of the same length along the longitudinal axis of the package and one of the movable tray section and the movable lid section is shorter than the other along said longitudinal axis.

13. A package for elongated items such as sewing machine needles or similar items, comprising:

a flat tray, which limits a housing space for the elongated items, at least on one side;

a flat lid part;

means connected to the flat tray for holding the lid part at a distance from and substantively parallel to the tray so as to limit the housing space on a side opposite the tray;

said tray having a movable tray section at one end thereof;

said lid part having a movable lid-part section at one end thereof and opposite the movable tray section of the tray;

a detachable connecting element connecting the tray section and the lid-part section to one another; and an abutment for the movable tray section provided on the lid part and limiting the pivot angle of the movable tray section.

14. The package according to claim 13, wherein the abutment is a clamping device for the lid part.

15. The package according to claim 14, wherein the tray has a flat, rectangular floor section that is provided with side walls that extend toward the lid part at two oppositely-located, parallel edges, and the abutment is formed by a protrusion that cooperates with wedge surfaces formed in the side walls.

16. The package according to claim 13, wherein the movable tray section has side wall sections that cooperate with the abutment and are supported against it.

17. A package for elongated items such as sewing machine needles or similar items, comprising:

a flat tray, which limits a housing space for the elongated items, at least on one side;

a flat lid part;

means connected to the flat tray for holding the lid part at a distance from and substantively parallel to the tray so as to limit the housing space on a side opposite the tray;

said tray having a movable tray section at one end thereof;

said lid part having a movable lid-part section at one end thereof and opposite the movable tray section of the tray, with the lid-part section having a latching tab that extends past the movable tray section when the package is closed; and a detachable connecting element connecting the tray section and the lid-part section to one another.

18. The package according to claim 17, wherein the latching tab is provided with a finger depression.

* * * * *